US006116875A

United States Patent [19]

Kolb et al.

[11] Patent Number: 6,116,875

[45] Date of Patent: Sep. 12, 2000

[54] DISPLACEMENT MACHINE FOR COMPRESSIBLE MEDIA

[75] Inventors: Roland Kolb, Regensdorf; Fritz Spinnler, Mellingen, both of Switzerland

[73] Assignee: SIG Schweizerische Industrie-Gesellschaft Industrieplatz, Rheinfall, Switzerland

[21] Appl. No.: 09/140,675

[22] Filed: Aug. 26, 1998

[30] Foreign Application Priority Data

Aug. 26, 1997 [CH] Switzerland ..... 1997 1983/97

[51] Int. Cl.[7] ..... F01C 1/02

[52] U.S. Cl. ..... 418/55.2; 418/60

[58] Field of Search ..... 418/55.2, 60

[56] References Cited

U.S. PATENT DOCUMENTS

| | | | |
|---|---|---|---|
| 3,989,422 | 11/1976 | Guttinger | 418/60 X |
| 4,626,179 | 12/1986 | Terauchi | 418/55.2 |
| 4,715,797 | 12/1987 | Guttinger | 418/55.2 |
| 4,861,244 | 8/1989 | Kolb et al. | 418/55.2 X |
| 4,950,138 | 8/1990 | Spinnler . | |
| 4,997,348 | 3/1991 | Kolb et al. . | |
| 5,171,140 | 12/1992 | Schaefer et al. . | |
| 5,340,292 | 8/1994 | Steele . | |

FOREIGN PATENT DOCUMENTS

| | | |
|---|---|---|
| 40 03 346 | 8/1990 | Germany . |
| 41 33 429 | 4/1992 | Germany . |
| 673 679 | 3/1992 | Switzerland . |

OTHER PUBLICATIONS

Patent Abstracts of Japan, JP 05 079462, Mar. 30, 1993.
Patent Abstracts of Japan, JP 09 079151, Mar. 25, 1997.

*Primary Examiner*—Hoang Nguyen
*Attorney, Agent, or Firm*—Oblon, Spivak, McClelland, Maier & Neustadt, P.C.

[57] ABSTRACT

A displacement machine for compressible media includes a displacer (1) which is arranged in a stationary housing. When the machine is operating, the displacer executes a circulating but non-rotating movement. Spiral bars (3, 3') are arranged perpendicularly on the disk (2). The bars (3, 3') have outer sealing faces (30, 30') and inner sealing faces (31, 31'). The beginning (32) of the outer sealing faces (30, 30') is offset with respect to the beginning (33) of the inner scaling faces (31, 31'), as viewed in the circumferential direction. This is correspondingly true of the end (34, 35) of the sealing faces. The bars (3, 3') engage in spiral delivery spaces in the housing and, when the machine is operating, the sealing faces (30, 30', 31, 31'), together with the cylindrical walls of the delivery spaces, form working chambers in a uniform rotational angle interval of the drive.

16 Claims, 6 Drawing Sheets

DISPLACEMENT MACHINE FOR COMPRESSIBLE MEDIA

BACKGROUND OF THE INVENTION

1. Field of the Invention

The present invention relates to a displacement machine for compressible media.

2. Description of the Related Art

A generic displacement machine based on the spiral principle is disclosed, for example, by DE-A-42 03 346. Machines of this type are distinguished by the fact that the delivery of the gaseous operating medium, consisting, for example, of air or an air/fuel mixture, has pulsations of relatively low amplitude, and can therefore advantageously be used also for charging purposes of internal combustion engines. In the operation of such a displacement machine, which operates as a compressor, a plurality of approximately sickle-shaped working chambers are enclosed along spiral delivery spaces between likewise spirally designed bars, which act as displacement bodies, and the two cylinder walls of the delivery spaces, because of the different curvature of the spiral shape, and these working chambers move from an inlet for the operating medium, through the delivery spaces, to an outlet, their volume being continuously reduced and the pressure of the operating medium being correspondingly increased. The two bars, which are in each case arranged on one side of an eccentrically driven disk, are offset by about 180° in relation to each other and extend over approximately 360°. Each bar, viewed in the radial direction, has outer and inner sealing faces which begin at the inlet-side beginning of the bars and end at the outlet-side end of the bars. Each of the bars thus forms, together with the corresponding cylinder wall of the associated delivery space, a working chamber at every 180° angle of rotation of the drive.

Swiss patent number 673 679 also shows in detail the manner in which, in the case of displacement machines based on the spiral principle, the working chambers are produced by a circulating movement of the bars that are fitted to the disk of the displacer, in co-operation with the spiral delivery spaces in the housing. Such working chambers are bounded both by the inside of the bar and by the outside. It is typical of this arrangement that, during the progressive rotary movement of the eccentric drive and guide shafts, a new working chamber is formed and, respectively, the filling operation of a working chamber is completed by a spiral bar approximately every 180° angle of rotation.

In the case of the displacement machine disclosed by DE-A-42 03 346 and Swiss patent number 673 679, having four delivery spaces, there being on each side of the disk two delivery spaces that are offset by about 180° with respect to each other, run spirally from the relevant inlet to the outlet and are arranged with mirror symmetry, during machine operation a filling operation of the operating chambers is completed in each case approximately every 180° angle of rotation of the eccentric drive and guide shafts. The sequence of opening the working chambers toward the central outlet behaves in a manner similar to the filling operation of the working chambers. In the four delivery spaces, as they have been described, the progressive movement of the spiral bars, which are held of the disk of the rotor, means that a total of eight working spaces are formed for each complete revolution of the shafts, in each case four of these working spaces working synchronously with each other. This leads to a low-frequency, pulsating delivery of the operating medium. The remaining irregularity, both of the intake volume flow and of the outgoing volume flow of the operating medium, produces a noise with a basic frequency of twice the speed of rotation of the drive.

Furthermore, in the case of the known displacement machines, the working chambers that are located on the inside and on the outside with reference to a bar have different volumes. This inequality of the working chambers may lead to undesired pulsations in the lines which lead the operating medium to the displacement machine or away from this.

If displacement machines of this type are used for charging internal combustion engines, this low-frequency noise may have a disruptive effect in machine operation. The damping of this noise is associated with additional cost both on the intake side and on the delivery side.

DE-A-41 33 429 discloses one possibility of disrupting the symmetric sequence of the intake and delivery cycles. The solution shown therein is based on displacing the delivery spaces in the housing and the spiral bars on the disk of the rotor in a polar manner with respect to one another in such a way that the sequence of the intake and delivery cycles is no longer uniform. Furthermore, the bars on the disk of the rotor are no longer arranged with mirror symmetry on both sides of the disk, but are again displaced in angular terms with respect to one another in relation to the axis of rotation of the eccentric drive shaft. This further increases the desired irregularity of the intake and delivery cycles of the machine.

However, this solution for smoothing the intake and delivery volume flow of the operating medium is accompanied by the disadvantage of the asymmetry of the reaction forces of the operating medium which act on the bars. In the case of the symmetrical design of the displacement machines according to DE-A-42 03 346 and Swiss patent number 673 679, the reaction forces which act on the bars from the delivery medium during machine operation act symmetrically, and the resulting reaction force lies in the plane of the disk of the rotor. As a result, no forces which would have to be countered by specific precautions are produced. On the other hand, in the case of an asymmetrical arrangement, as is disclosed in DE-A-41 33 429, tilting forces are certainly produced, and are caused both by the unequal loading, brought about by the reaction forces of the operating medium, and as a result of the asymmetrical arrangement of the bars and the therefore non-uniform mass distribution on the disk. The second cause, that of the asymmetrical mass distribution, has a damaging effect in particular at high rotational speeds, since the inertial forces or mass forces are particularly high in such operating conditions.

SUMMARY OF THE INVENTION

Thus, one of the objects of the present invention is to provide a generic displacement machine during whose operation almost complete smoothing of the pulsations results.

At a given rotational speed of the drive, the displacement machine according to the invention has an increased periodicity of the intake and delivery cycles. As a result, any pulsations only have very small amplitudes.

Furthermore, the present invention permits a completely symmetrical arrangement of the bars on the disk, which also helps to prevent or to reduce the pulsations and the tilting moments on the displacer.

If the displacement machines disclosed by DE-A-42 03 346 and Swiss patent number 673 679 are designed in accordance with the invention, it is no longer two groups of four working chambers which work with one another synchronously, but rather four groups of two working chambers. In each case, two working chambers complete their intake operation approximately every 90° angle of rotation of the drive. This is analogously true for the expulsion operations.

BRIEF DESCRIPTION OF THE DRAWINGS

The drawing illustrates a displacement machine having a displacer of known construction and an exemplary embodiment of a displacement machine according to the invention. In the drawing, purely schematically.

DETAILED DESCRIPTION OF THE PREFERRED EMBODIMENTS

Figure 1:
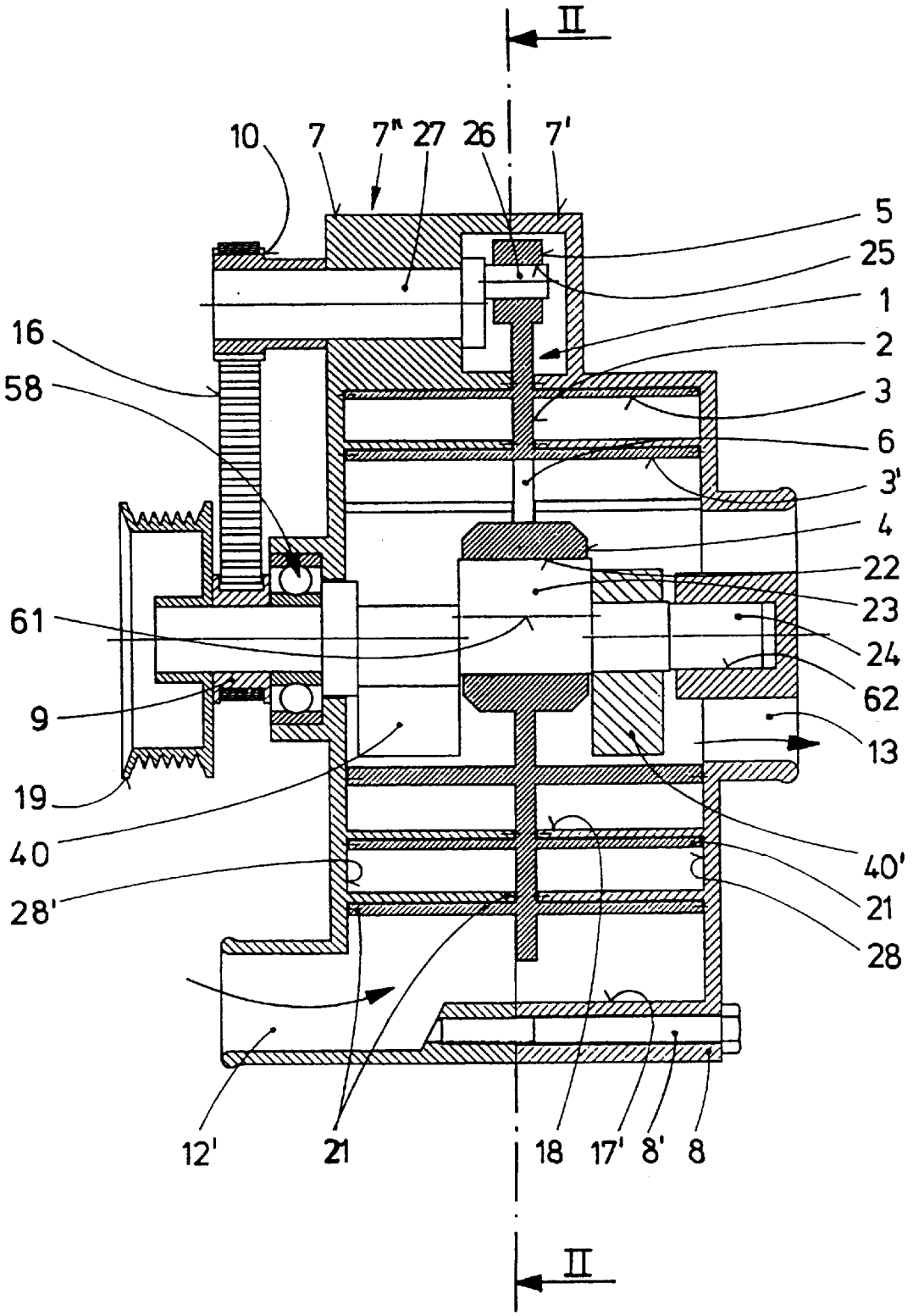
FIG. 1 shows a displacement machine in longitudinal section along the line I—I of FIG. 2.

As shown in FIG. 1, a displacer 1 belongs to a displacement machine and is arranged as a rotor in a housing 7". Arranged on both sides of a disk 2 of the displacer 1 are in each case two displacer bodies which are offset in relation to each other by at least approximately 180° and run spirally; in this case these are bars 3, 3' which are held perpendicularly on the disk 2. In the example shown, the spirals themselves are formed from a plurality of mutually adjoining circular arcs. Because of the large ratio, which can be seen from FIG. 1, between the axial length and the wall thickness, the inlet-side end of the bars 3, 3' is in each case of reinforced design. 4 designates a hub, with which the disk 2 is drawn onto a bearing 22. The bearing 22 itself is fitted on an eccentric disk 23, which for its part is part of a drive shaft 24. 5 designates an eye which belongs to the disk 2, is arranged radially outside the bars 3, 3' and accommodates a guide bearing 25 which is drawn onto an eccentric bolt 26. The latter is, for its part, part of a guide shaft 27, which is also mounted on the housing 7". The eccentricity e (FIG. 2) of the eccentric disk 23 on the drive shaft 24 corresponds to that of the eccentric bolt 26 on the guide shaft 27. On the outlet side of the bars 3, 3' there are apertures 6 in the disk 2, in order that the operating medium can pass from one side of the disk to the other, for example to be led away through a central outlet 13, which is integrally molded on that housing part 7' of the housing 7" which is shown on the right in FIG. 1. 19 designates a pulley, which is rotationally fixedly connected to the drive shaft 24.

The drive shaft 24 is guided by means of a bearing 58 in a housing part 7, which is shown on the left in FIG. 1, and by means of a bearing 62 in the housing part 7'. The displacer 1 is driven by the pulley 19 via the drive shaft 24. Rotationally fixedly seated on the guide shaft 27, which is likewise mounted on the housing part 7", there is also a toothedbelt belt pulley 10, which is coupled to the toothedbelt pulley 9 by means of a toothed belt 16 so that the drive shaft 27 can be driven synchronously and at precisely the same angle as the drive shaft 24. By means of the drive being designed in this way, the displacer 1, when the machine is operating, executes a circulating but non-rotating pushing movement. 40, 40' are centrifugal weights which are fitted to the drive shaft 24. They are used to balance the centrifugal force exerted by the displacer 1 on the eccentric disk 23 during machine operation.

Figure 2:
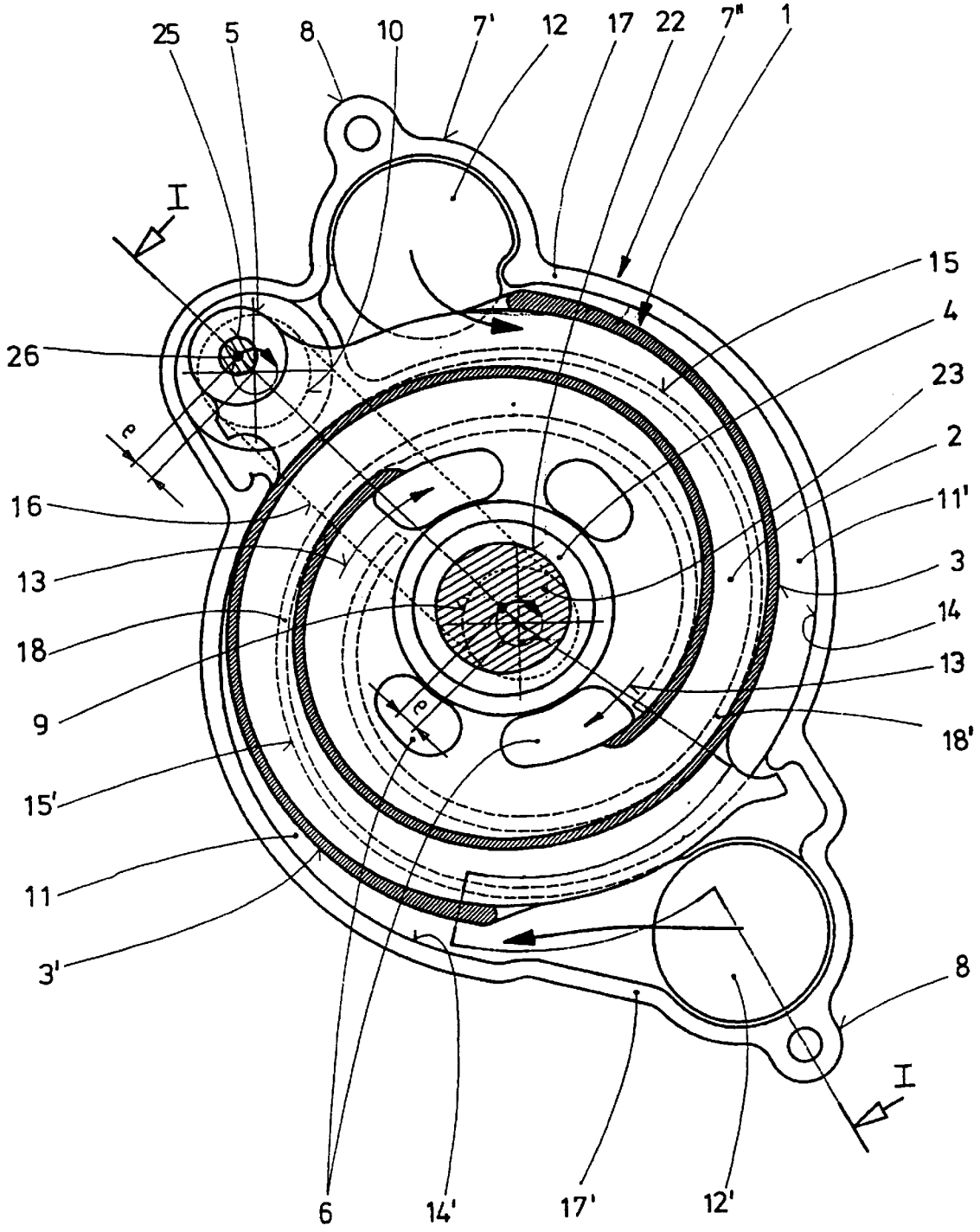
FIG. 2 shows a housing part of the housing, parted along the line II—II of FIG. 1, with a displacer of known construction located therein.

FIG. 2 shows the housing part 7', illustrated on the left in FIG. 1, of the housing 7", which is composed of two housing parts 7, 7' which adjoin each other axially and are connected to each other via fastening eyes 8 for the accommodation of screw fixings 8'. 11 and 11' designate two delivery spaces, which are in each case offset by 180° in relation to each other and are machined in the manner of a spiral slit into each of the two housing parts 7, 7'. They run from each inlet 12, 12', which is arranged at the radially outer circumference of the spiral in the housing 7", to the centrally arranged outlet 13, which is common to both delivery spaces 11, 11'. They have essentially parallel cylinder walls 14, 14', 15, 15', which are arranged with a constant spacing from each other and in the present case enclose a spiral of about 360°, like the bars 3, 3' on the disk 2. The bars 3, 3' engage between the cylinder walls 14, 14' and 15, 15', respectively, the curvature of said bars being such that they virtually touch the radially outer and radially inner cylinder walls 14, 14' and 15, 15' of the housing 7" during operation at a plurality of points, for example at two points in each case. Because of the alternating approach, caused by the drive, of the bars 3, 3' to the inner cylinder walls 15, 15' and outer cylinder walls 14, 14' of the associated delivery spaces 11, 11', the result on both sides of the bars 3, 3' is sickle-shaped working chambers, which enclose the operating medium and, while the displacer 1 is being driven, are displaced through the delivery spaces 11, 11' in the direction of the outlet 13. At the same time, the volumes of these working chambers decrease, and the pressure of the operating medium is correspondingly increased. In relation to the fundamental mode of operation of displacement machines of this type, reference is also made to DE-C-26 03 462.

It can also be seen from FIG. 2 that, in the region of the inlet 12', a web 17' having the outer cylinder wall 14' is continued in a web 18', also having the inner cylinder wall 15. This measure also occurs in the region of the inlet 12. Here, the transition takes place from a web 17 to a web 18. At the free ends of the bars 3, 3' and of the webs 17, 17', 18, 18', seals 21 are inserted into corresponding grooves. Said seals are used to seal the working spaces with respect to the side walls 28, 28' of the housing and, respectively, with respect to the displacer disk 2.

Figure 3:
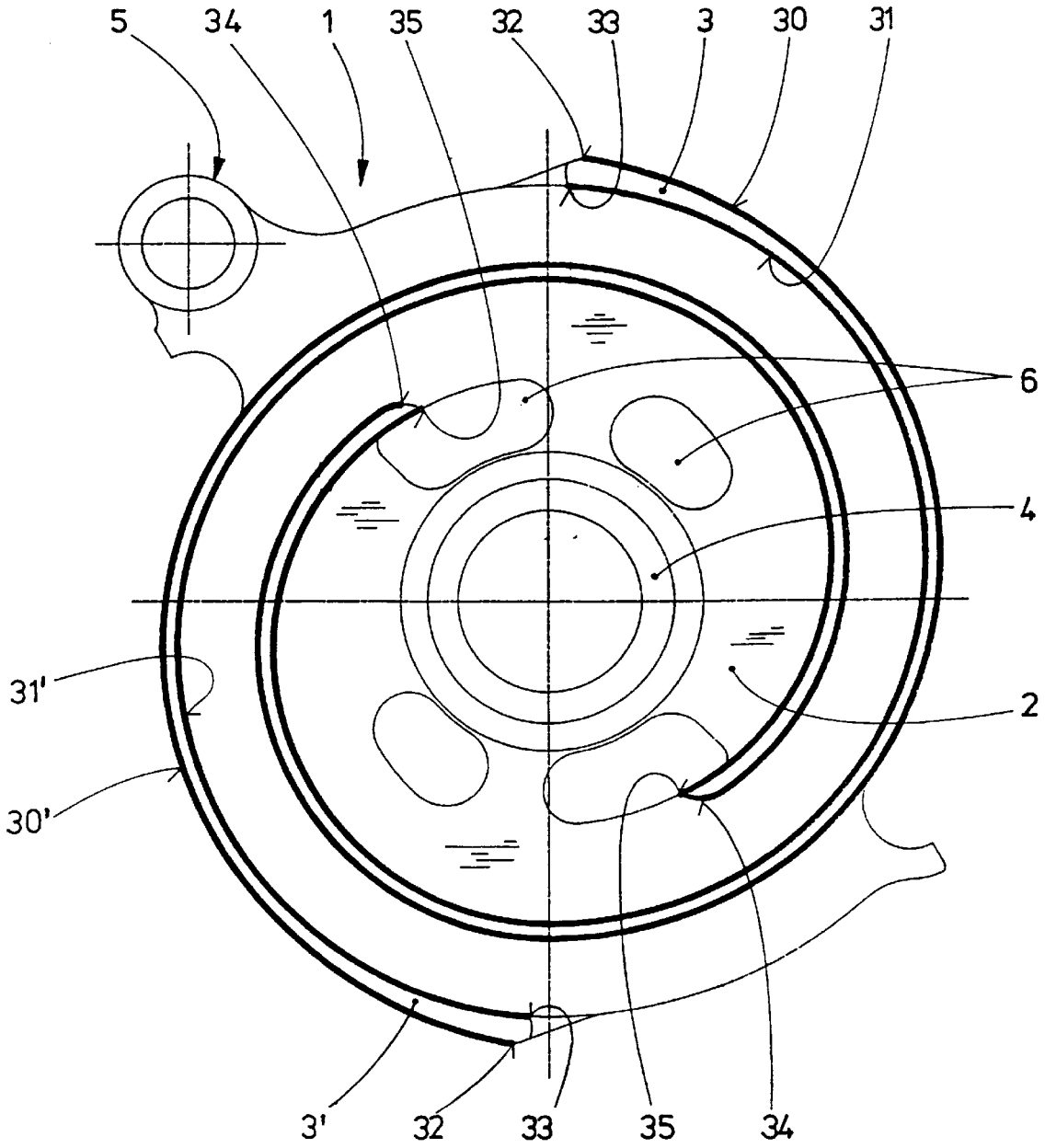
FIG. 3 shows, in front view, a displacer of known construction with spiral bars.

To illustrate further the mode of operation of the displacement machine, the displacer 1, of known construction, is illustrated separately in FIG. 3. In this figure, those sections of the bars 3, 3' which form the radially outer and radially inner sealing faces 30, 30' and 31, 31' and approach the outer cylinder walls 14, 14' and inner cylinder walls 15, 15' of the delivery spaces 11, 11' machined into the housing parts 7, 7', in order to form and displace the working chambers, are drawn in bold.

In this design of the displacer 1, the inlet-side beginning 32, 33 and the outlet-side end 34, 35 of the inner sealing faces 31, 31' and outer sealing faces 30, 30', as viewed in the direction of motion of the delivery medium and thus in the circumferential direction, are located approximately opposite one another.

Figure 4:
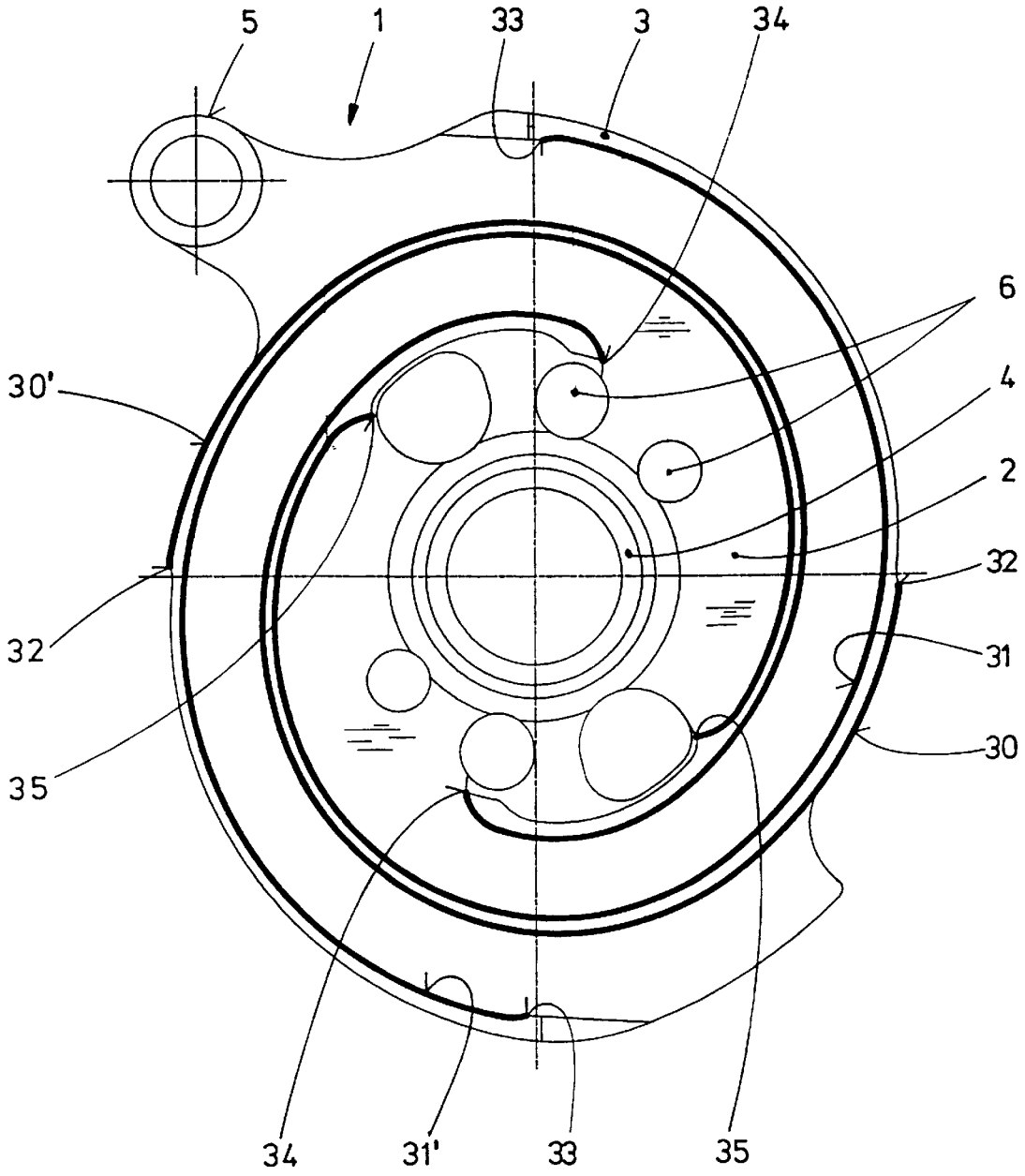
FIG. 4 shows, in front view, a displacer according to the invention.

FIG. 4 shows a displacer 1 which is designed according to the invention and in which the—likewise drawn in bold—sealing faces 30, 31 and 30', 31' on the bars 3, 3' are arranged to be offset in the circumferential direction. The beginning 32 of the respectively outer sealing face 30, 30' is clearly displaced toward the outlet 13 with respect to the beginning 33 of the respectively inner sealing face 31, 31'. This is correspondingly true of the ends 34, 35 of the outer and inner sealing faces 30, 30' and 31, 31'.

As can be taken from FIGS. 5*a* to 5*d*, the webs 17, 17' have beads 36 which project towards the inside and are intended to cooperate with the beginning 32 of the relevant outer sealing face 30 or 30'. The webs 18, 18' are provided on their outer side with a depression 37, which is intended to cooperate with the beginning 33 of the respectively inner sealing face 31, 31'. In addition, the webs 18, 18' have thickening 38 which project in the inward direction and are intended to cooperate with the ends 34 of the outer sealing faces 30, 30'. In a corresponding way, the bars 3, 3' have, at the end 35 of the inner sealing faces 31, 31', an inwardly projecting thickening 39 which is intended to cooperate with that end of the webs 18, 18' which is on this side.

The mode of operation of the inventive displacement of the beginnings 32, 33 and ends 34,35 of the sealing faces 30, 30', 31,31' on the bars 3, 3' emerges from FIGS. 5*a* to 5*d*. For improved clarity, the displacer 1 is illustrated as being located on the inside in the housing part 7', in a manner similar to that of FIG. 2.

Figure 5B:
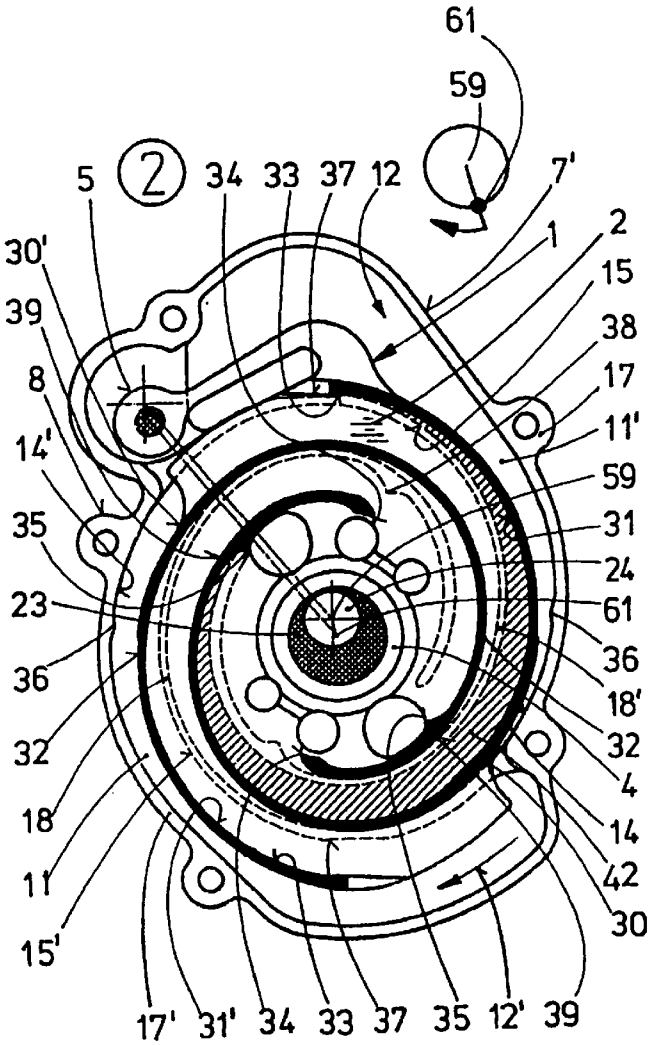
FIG. 5*b* shows, in the same illustration as FIG. 5*a*, the displacement machine shown there at a second point in time in the working cycle, at which the drive has rotated through 90° in the clockwise direction.
Figure 5A:
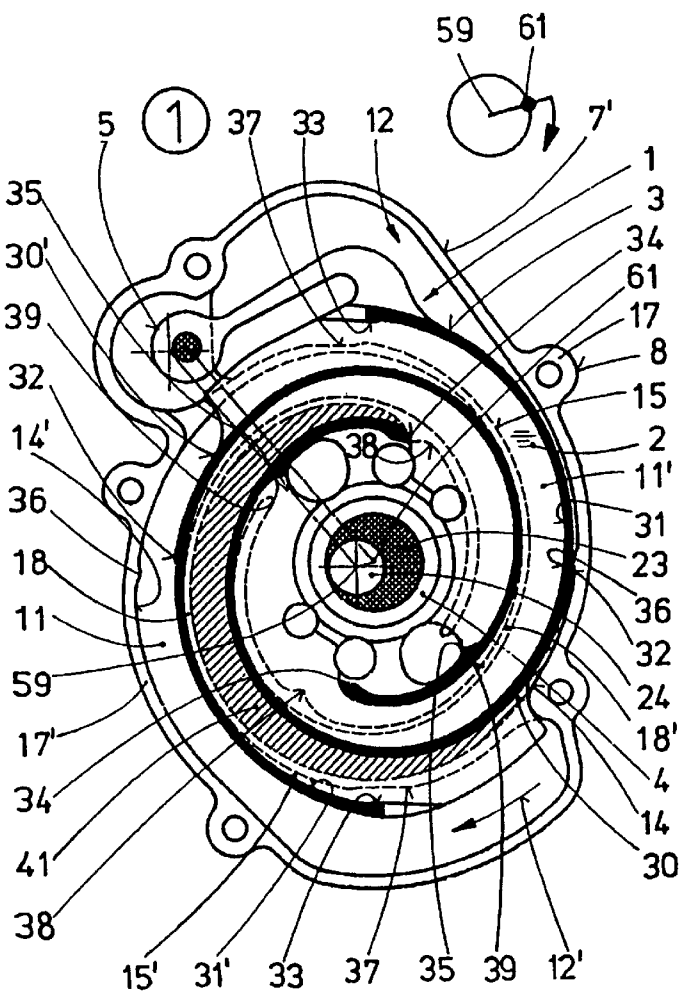
FIG. 5*a* shows, in front view, an opened housing with a displacer arranged therein of a displacement machine according to the invention at a first point in time in a working cycle, in which the drive assumes a zero-degree starting position.

FIG. 5*a* shows the displacer 1 in a first position, in which the outer spiral sealing face 30 of the bar 3 has enclosed a first working chamber 41, which is identified by hatching. The rotational angle position of the drive is shown alongside the housing 7", using the position of the center of rotation 59 of the drive shaft 24 and of the central axis 61 of the eccentric disk 23.

FIG. 5*b* shows the displacer 1 in a second position, in which the drive has rotated in the clockwise direction by about 90° rotational angle interval in relation to the position shown in FIG. 5*a*. In this position, the working chamber 41 is open on the outlet side, and the inner spiral sealing face 31 of the bar 3 encloses a second working chamber 42, which is likewise identified by hatching. This working chamber 42 has at least approximately the same size as the working chamber 41.

Figure 5D:
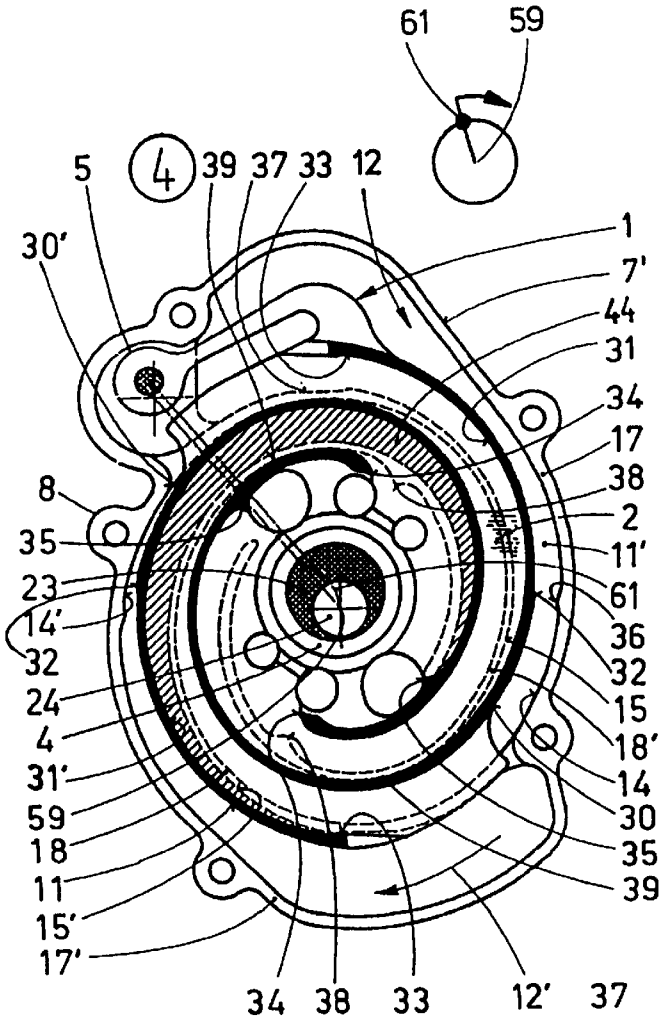
FIG. 5*d* shows, in the same illustration as FIG. 5*a*, the displacement machine shown there at a fourth point in time in the working cycle, at which the drive has rotated through 270° in the clockwise direction.
Figure 5C:
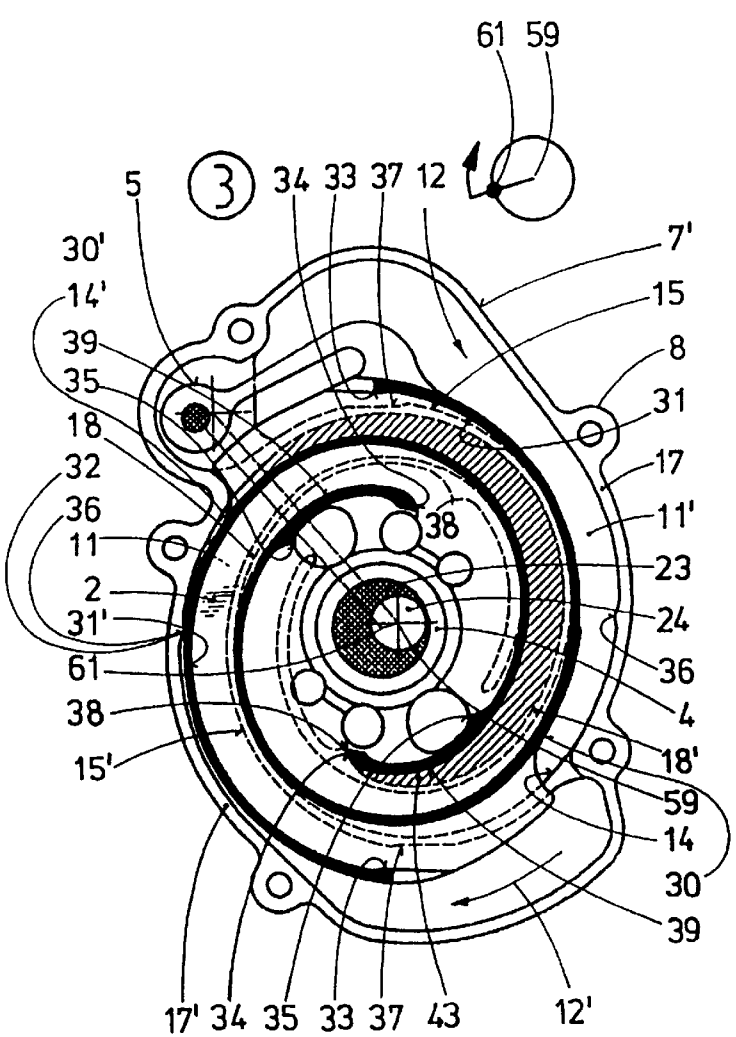
FIG. 5*c* shows, in the same illustration as FIG. 5*a*, the displacement machine shown there at a third point in time in the working cycle, at which the drive has rotated through 180° in the clockwise direction.

In a corresponding way, FIGS. 5*c* and 5*d* show the working chambers 43 and 44 which are enclosed by the outer sealing face 30' and inner sealing face 31' and are formed during the further rotation of the drive through approximately 90° rotational angle interval in each case.

It is thus apparent from FIGS. 5*a* to 5*d* that, according to the invention, in each case a working chamber 41, 42, 43, 44 is enclosed on each side of the disk 2 of the rotor 1 at intervals of approximately 90° rotational angle interval of the drive. The bars 3, 3' are arranged symmetrically with respect to the disk 2 of the displacer 1, and the beginnings 32, 33 and ends 34, 35 of the sealing faces 30, 30', 31, 31' are placed in such a way that the working chambers produced per revolution of the drive, when the machine is operating, are approximately equally large.

What is claimed is:

1. A displacement machine for compressible media, comprising:

at least two delivery spaces which are arranged in a housing and lead spirally from a radially outer inlet to a radially inner outlet;

a displacer which, when operating, executes a circulating but non-rotating movement; and a disk with spiral bars arranged on one side of said disk, said bars, as viewed in the radial direction, having outer and inner sealing faces which cooperate with outer and inner cylindrical walls of said delivery spaces in order, when operating, to form working chambers that move from said radially outer inlet to said radially inner outlet, wherein said outer and inner sealing faces are offset, as viewed in a circumferential direction, in order to form a working chamber each in a uniform rotational angle interval of the movement of the displacer, and wherein said spiral bars have end regions that are symmetrically opposite one another as viewed in the circumferential direction.

2. The displacement machine according to claim 1, wherein the outer and inner sealing faces have beginnings on the inlet side which are arranged on the bars in such a way that, at least approximately in the rotational angle interval of 90°, a working chamber is in each case closed.

3. The displacement machine according to claim 1, wherein said outer and inner sealing faces have ends on the outlet side which arc arranged on the bars in such a way that, at least approximately in the rotational angle interval of 90°, a working chamber is in each case opened.

4. The displacement machine according to claim 1, wherein on a first side of said disk, two bars are arranged offset by 180°, and on each of said two bars said outer sealing face is arranged so that it is offset in relation to said inner sealing face by at least approximately a rotational angle interval of 90°.

5. The displacement machine according to claim 1, wherein said outer and inner sealing faces have beginnings on the inlet side wherein said beginnings and said ends on the outlet side of said outer and inner sealing faces are arranged on said bars in such a way that said working chambers are at least approximately equally large when closed and at least approximately equally large when opened.

6. The displacement machine according to claim 1, wherein bars are arranged on both sides of said disk, with mirror symmetry to the latter, and cooperate with associated delivery spaces.

7. The displacement machine according to claim 2, wherein said outer and inner sealing faces have ends on the outlet side which are arranged on the bars in such a way that, at least approximately in the rotational angle interval of 90°, a working chamber is in each case opened.

8. The displacement machine according to claim 2, wherein on a first side of said disk, two bars are arranged offset by 180°, and on each of said two bars said outer sealing face is arranged so that it is offset in relation to said inner sealing face by at least approximately a rotational angle interval of 90°.

9. The displacement machine according to claim 3, wherein on a first side of said disk, two bars are arranged offset by 180°, and on each of said two bars said outer sealing face is arranged so that it is offset in relation to said inner sealing face by at least approximately a rotational angle interval of 90°.

10. The displacement machine according to claim 2, wherein said beginnings on the inlet side and said ends on the outlet side of the outer and inner sealing faces are arranged on said bars in such a way that the working chambers are at least approximately equally large when closed and at least approximately equally large when opened.

11. The displacement machine according to claim 3, wherein said beginnings on the inlet side and said ends on the outlet side of the outer and inner sealing faces are arranged on said bars in such a way that the working chambers are at least approximately equally large when closed and at least approximately equally large when opened.

12. The displacement machine according to claim 4, wherein said beginnings on the inlet side and said ends on the outlet side of the outer and inner sealing faces are arranged on said bars in such a way that the working chambers are at least approximately equally large when closed and at least approximately equally large when opened.

13. The displacement machine according to claim 2, wherein bars are arranged on both sides of said disk, with mirror symmetry to the latter, and cooperate with associated delivery spaces.

14. The displacement machine according to claim 3, wherein bars are arranged on both sides of said disk, with mirror symmetry to the latter, and cooperate with associated delivery spaces.

15. The displacement machine according to claim 4, wherein bars are arranged on both sides of said disk, with mirror symmetry to the latter, and cooperate with associated delivery spaces.

16. The displacement machine according to claim 5, wherein bars are arranged on both sides of said disk, with mirror symmetry to the latter, and cooperate with associated delivery spaces.

* * * * *